United States Patent [19]

Hays, Jr.

[11] Patent Number: 4,986,155

[45] Date of Patent: Jan. 22, 1991

[54] CUTTING APPARATUS FOR EXTRUDED MATERIALS

[75] Inventor: Donald F. Hays, Jr., Silver Lake Village, Ohio

[73] Assignee: Extrusion Services, Inc., Stow, Ohio

[21] Appl. No.: 255,971

[22] Filed: Oct. 11, 1988

[51] Int. Cl.[5] ..... B26D 5/20

[52] U.S. Cl. ..... 83/222; 83/229; 83/241; 83/257; 83/263; 83/416; 83/436; 83/734; 74/118; 74/125.5; 74/141.5; 192/15; 192/48.92

[58] Field of Search ..... 83/222, 225, 226, 227, 83/229, 230, 241, 257, 263, 416, 436, 563, 613, 734; 74/118, 125.5, 141.5; 192/12 B, 15, 48.92

[56] References Cited

U.S. PATENT DOCUMENTS

| | | | |
|---|---|---|---|
| 3,165,959 | 1/1965 | Eidson | 83/241 X |
| 3,664,220 | 5/1972 | Blair | 83/257 X |
| 3,735,657 | 5/1973 | Schmidt et al. | 83/222 X |
| 3,776,079 | 12/1973 | Steinberg et al. | 83/225 |
| 3,779,114 | 12/1973 | Rabin | 83/241 X |
| 3,918,336 | 11/1975 | Macey et al. | 83/257 X |
| 4,030,394 | 6/1977 | Kistner et al. | 83/734 X |
| 4,089,451 | 5/1978 | Zlaikha | 83/229 X |
| 4,869,490 | 9/1989 | Reid | 74/125.5 X |

*Primary Examiner*—Hien H. Phan
*Assistant Examiner*—Eugenia A. Jones
*Attorney, Agent, or Firm*—Renner, Kenner, Greive, Bobak, Taylor & Weber

[57] ABSTRACT

Apparatus (10) for repeatedly cutting extruded rubber and plastic material (M) at preselected locations along a length thereof including, a frame (11), a drive shaft (35) mounted on the frame, a drive member (25) effecting a selected speed of rotation of the drive shaft, feed rolls (110) intermittently driven by the drive shaft for controllably advancing the extruded material, and a cutting element (B) reciprocally driven by the drive shaft for repeatedly cutting the extruded material advanced by the feed rolls at the preselected locations.

14 Claims, 6 Drawing Sheets

CUTTING APPARATUS FOR EXTRUDED MATERIALS

TECHNICAL FIELD

Generally, the invention relates to cutting apparatus for materials extruded in the rubber and plastics industry. More particularly, the invention relates to a cutter for severing rubber and plastic materials at rates at which the material is extruded More specifically, the invention relates to a cutter which may be employed in an extrusion line for rubber or plastic materials to make repeated, high speed cuts at extrusion machine production rates forming quantities of cut products of a precise preselected length.

BACKGROUND ART

A wide variety of machines for extruding rubber and plastic materials have been in use for many years. In recent years technical developments have made possible the extrusion of a wider range of materials, products of greater size and more intricate cross-sectional configurations, and faster extrusion rates under virtually all circumstances. As a result, increasing numbers of components and parts once fabricated by different methods due to material, tolerance or size limitations are now processed in extrusion lines. While separate or off-line cutting operations were at one time used extensively, such are normally deemed relatively expensive in terms of apparatus and/or labor costs by current standards.

Therefore, extruder lines consist generally of an extruder which produces an endless flow of product and on-line cutting apparatus which severs the product to predetermined lengths. Types of products which are commonly produced include flat goods in the nature of seals or weather stripping and tubular goods such as various types of hosing and tubing. Extruder lines are commonly available which are capable of handling goods which may be from a fraction of an inch in maximum dimension up to 6 inches or greater. The number of cuts per minute and thus the number of pieces by way of production rate per minute may include requirements of from a few cuts per minute to in excess of one thousand cuts per minute.

A great variety of cutting apparatus has been developed for affecting cutting of the endless flow of product emanating from an extruder. Depending upon the material being processed, the product may be either push or pull fed into the proximity of the cutter area of the cutting apparatus at substantially the linear extrusion rate of the extruder. A substantial number of on-line cutters designed over the years mount one or more blades on a rotating flywheel. The blade is set to rotate at a speed to provide the necessary linear length of cut extrusion for the rate at which material is extruded and fed to the cutter. These flywheel cutters operate on a timing basis in that cuts are repeatedly made at each duration of a selected time interval, thus assuming that the exact desired cut length of material will pass the knife cutting point during each time interval.

These flywheel cutters experienced variations in the length of the cut material under operating conditions which could even minutely vary the extruder feed rate. In addition, these cutters are difficult to set up without extensive trial and error correction and require resetting whenever the extrusion rate is altered. In many instances these cutters became known as maintenance-prone for a variety of reasons.

More recently rotating knife cutters have been developed which employ some different but some substantially identical features. These cutters employ a clutch/-brake system which, upon a signal, rapidly rotates the knife through one revolution, then stops and repeats on repetitions of the signal. Rather than operating on a time basis between signals, recent rotating knife cutters employ control devices which physically measure each predetermined length of material and then produce a knife activating signal. Such control devices may employ measuring wheels, mechanical trips or electric eyes to provide accurate measurement of each length of material. While these rotating knife cutters generally achieve improved accuracy and operating speeds in relation to flywheel cutters, they are not without attendant disadvantages. For example, the clutch/brakes and controls need to be highly accurate and therefore sophisticated which makes the cutter initially relatively expensive as well as more complex and costly to maintain and repair. Thus, the various types of cutting apparatus currently being employed are commonly subject to some disadvantages in terms of operation, cost considerations, or both.

DISCLOSURE OF THE INVENTION

Therefore, an object of the present invention is to provide cutting apparatus for rubber and plastic materials which insures a capability of high speed, consistent operation. Another object of the present invention is to provide such cutting apparatus which produces extruded materials repeatedly cut to a precise selected length. Still another object of the present invention is to provide such cutting apparatus wherein the extruded material is cleanly and perfectly linearly cut during each operating cycle of the apparatus irrespective of the speed of the extruded material or the preselected cut length of extruded material.

Another object of the present invention is to provide cutting apparatus wherein the feed rolls and the cutting blade are mechanically synchronized to insure precise repeat cutting operations irrespective of the linear feed rate of extruded material and the selected length of cut material. Still another object of the present invention is to provide such cutting apparatus wherein the feed of the extruded material is stopped during operation of the cutting knife, thereby insuring a linear, clean cut irrespective of operating speed of the apparatus. Still another object of the present invention is to provide such cutting apparatus which has a common drive for both the feed rolls for the extruded material and the activation of the cutting knife.

Yet another object of the invention is to provide a cutting knife which is reciprocally rather than rotationally moved through the cutting area to sever the extruded material. Yet another object of the invention is to provide an intermittent drive for the feed rollers for the extruded material which includes a clutch assembly for driving the rolls solely in one direction and a dynamic brake which instantaneously stops the feed rolls when not being driven by the clutch assembly.

Still a further object of the invention is to provide cutting apparatus which positively maintains the accuracy and quality of cuts irrespective of the number of cuts made per minute within the relatively high operating speed capability of the apparatus. Still a further object of the present invention is to provide cutting apparatus wherein adjustments in the speed of the rolls feeding extruded materials and the cutting cycle may be readily made to accommodate varying linear speeds of the extruded material and a selected cut length of the extruded material. Another object is to provide such cutting apparatus which is relatively inexpensive, easy to adjust, maintain and service, and which employs conventional reliable elements, with an absence of highly sophisticated, expensive controls which may be prone to operating problems under the repetitious operation of the apparatus. Still a further object of the present invention is to provide such a cutter which is capable of accommodating a normal factory environment without the necessity for undue service and in which the various components are readily assessable for such servicing, repair or replacement as might be required.

In general, the present invention contemplates apparatus for repeatedly cutting extruded rubber and plastic material at preselected locations along a length thereof including, a frame, a drive shaft mounted on the frame, a drive member effecting a selected speed of rotation of the drive shaft, feed rolls intermittently driven by the drive shaft for controllably advancing the extruded material, and a cutting element reciprocally driven by the drive shaft for repeatedly cutting the extruded material advanced by feed rolls at the preselected locations.

PREFERRED EMBODIMENT FOR CARRYING OUT THE INVENTION

Exemplary cutting apparatus embodying the concepts of the present invention for repeatedly severing extruded rubber and plastic material is depicted by the numeral 10 in FIGS. 1–5 of the drawings. The cutting apparatus will be described as it would be constituted for on line processing of a continuous length of rubber or plastic material being emitted from an extruder; however, the apparatus could be otherwise embodied in off line processing of lengths of rubber or plastic material into shorter lengths.

Figure 1A:
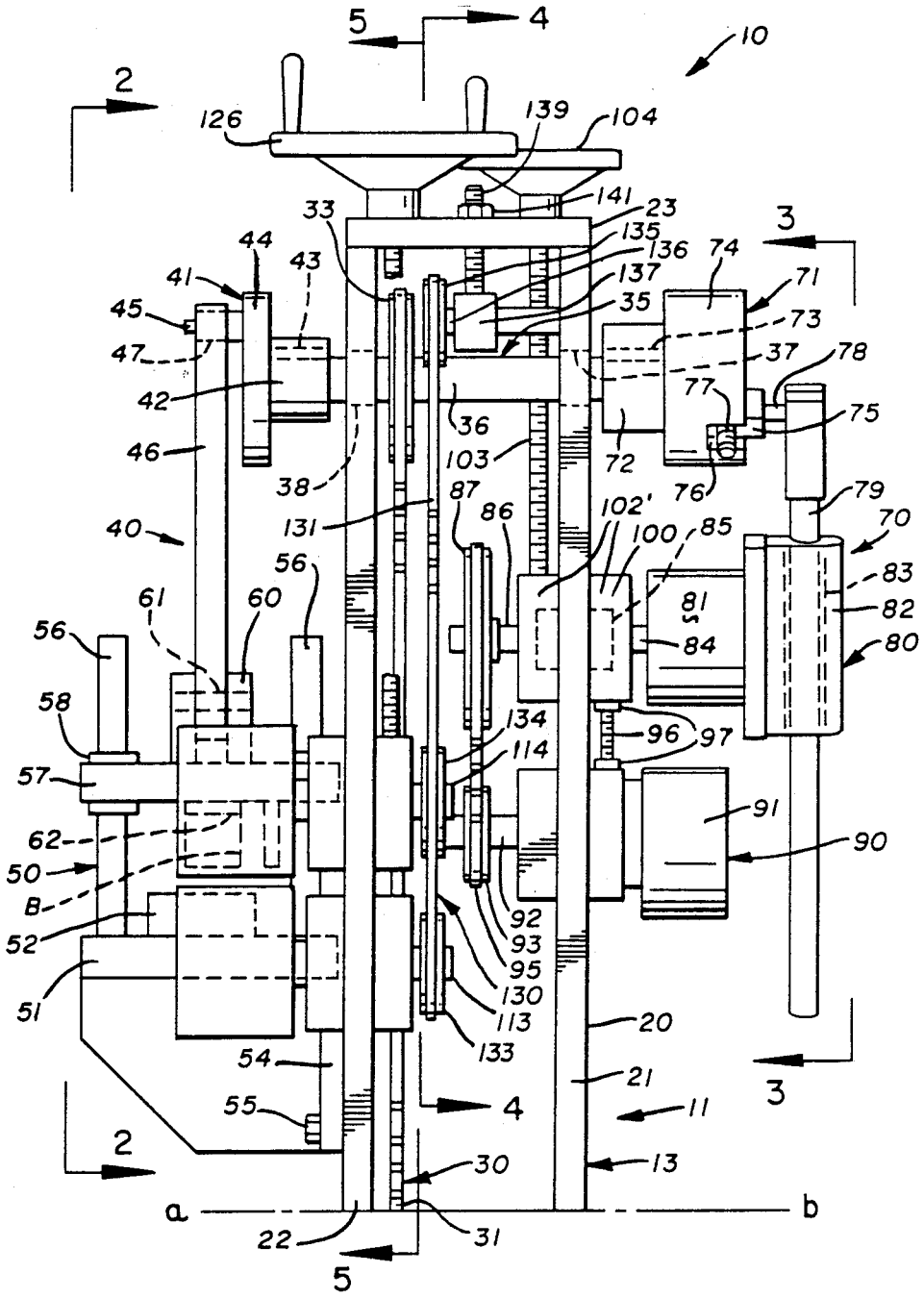
FIGS. 1*a* and 1*b*, on two sheets, line a–b of FIG. 1*a* joining with line a'–b' of FIG. 1*b*, comprise a fragmentary end elevational view of cutter apparatus embodying the concepts of the present invention.
Figure 1B:
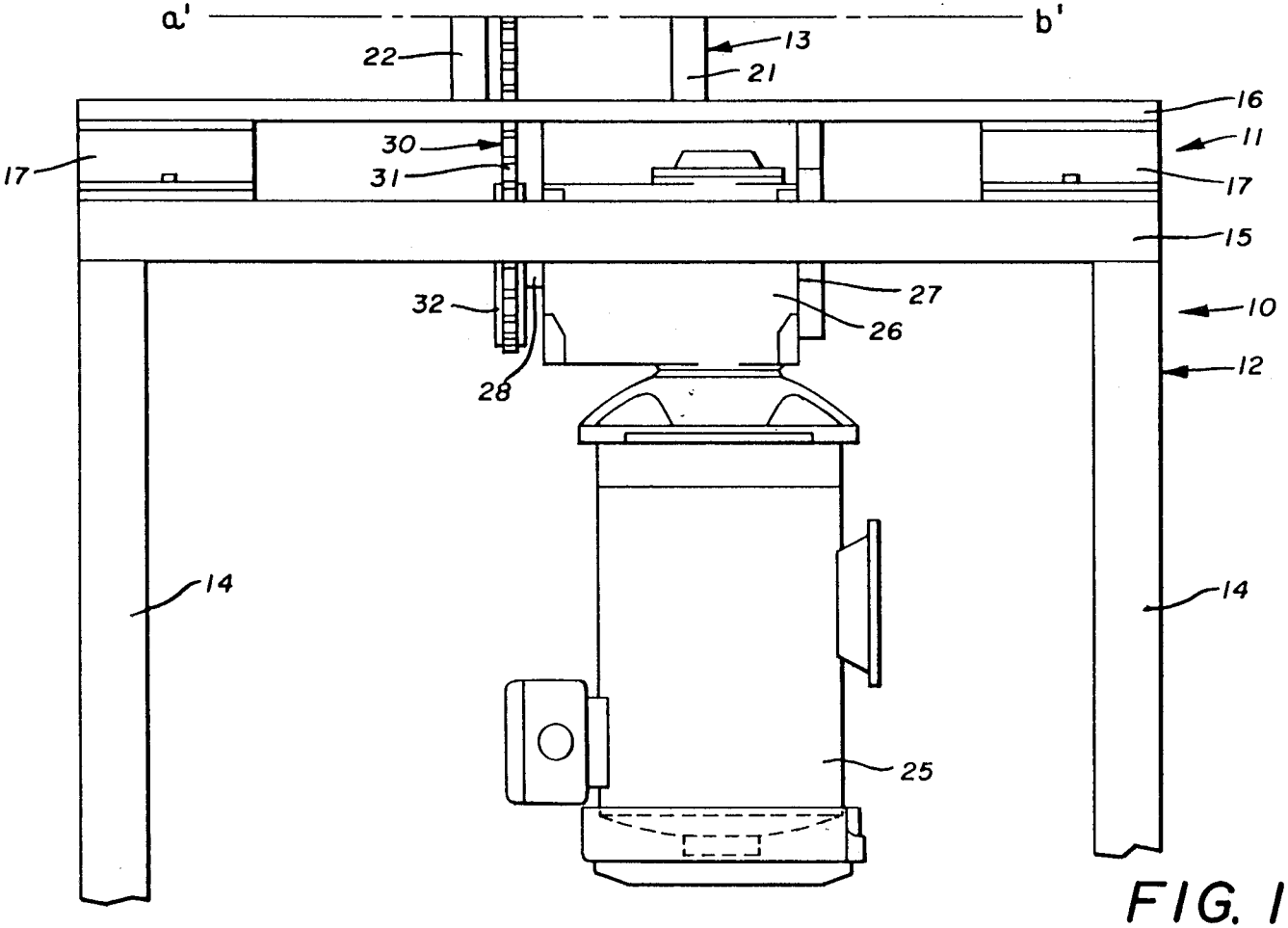

As shown in FIGS. 1*a* and 1*b* the cutter 10 includes an upstanding frame, generally indicated by the numeral 11. The frame 11 consists of a lower frame, generally indicated by the numeral 12, which supports an upper frame, generally indicated by the numeral 13, thereon. As shown, the lower frame 12 may conveniently be in the nature of a rectangular table having preferably four legs 14 which project downwardly for setting on a floor or other surface. The legs 14 are spaced and joined by a plurality of braces 15, all as best seen in FIG. 1*b* of the drawings. Positioned a distance above the braces 15 is a platform or table 16 which supports the upper frame 13. The platform 16 may be supported on the braces 15 by one or more vibration damping mounts 17 such that vibration imparted to the upper frame 13 is not transmitted to the lower frame 12.

The upper frame 13, best seen in FIG. 1*a*, reposes atop the platform 16 of lower frame 12 and is in the nature of a U-shaped, open-ended enclosure 20. The U-shaped enclosure 20 consists of a pair of parallel side plates 21 and 22 which repose atop and are attached as by welding or other fastening elements to the platform 16 of the lower frame 12 (FIG. 1*b*). The side plates 21, 22 are spaced and joined at the extremity opposite platform 16 by a top plate 23 to thus complete the U-shaped enclosure 20. Thus, the upper frame 13, complete with its attachment to platform 16, provides an open-ended rectangular frame of substantial strength for mounting the components of the cutting apparatus 10 described hereinafter.

Referring now to FIG. 1*b*, the cutting apparatus 10 is powered by a drive motor 25 which may conveniently be positioned below the platform 16 of the lower frame 12 and within the confines of the legs 14 forming the rectangular table. The drive motor 25 may be a conventional direct current motor sized for the capacity and operation of the cutting apparatus 10 as would be appreciated by persons skilled in the art. The rotational speed of drive motor 25 is adjustable as by a conventional variable speed control (not shown) which may be remotely set as by a hand knob (not shown) which may be located on frame 11 in a position convenient to an operator of the cutting apparatus 10. The drive motor 25 is interconnected in conventional fashion with a gear reducer 26 having a mounting plate 27 or other appurtenances for attachment of gear reducer 26 and drive motor 25 to the lower frame 12, such as to a brace 15. The gear reducer 26 has an output shaft 28 which couples rotational power supplied by the drive motor 25 to other elements of the cutting apparatus 10.

Rotational power supplied from drive motor 25 through gear reducer 26 is transmitted via a main drive chain assembly, generally indicated by the numeral 30, best seen in FIGS. 1*a* and 1*b*. The main drive chain assembly, as depicted, includes an elongate continuous drive chain 31 which engages a drive sprocket 32 attached to the shaft 28 of gear reducer 26 for rotation therewith (FIG. 1*b*). The extremity of drive chain 31 opposite the sprocket 32 engages a driven sprocket 33 of the main drive chain assembly 30 (FIG. 1*a*).

Figure 5:
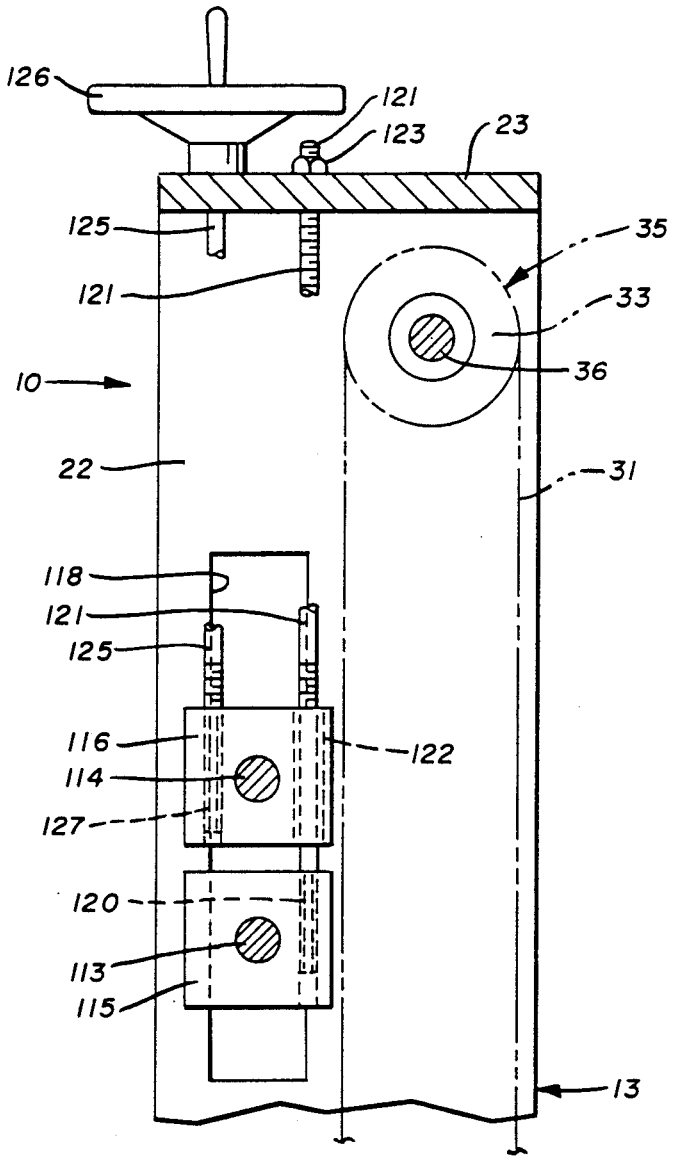
FIG. 5 is a fragmentary sectional view taken substantially along the line 5—5 of FIG. 1*a* and depicting, particularly, the main drive chain and the mounting elements for the feed rolls.

The driven sprocket 33 of the main drive chain assembly 30 is relatively rotationally affixed on a main drive shaft assembly, generally indicated by the numeral 35. As seen in FIGS. 1*a* and 5, the main drive shaft assembly 35 includes a main drive shaft 36 which extends between and through the side plates 21 and 22 of the upper frame 13. The main drive shaft 36 is appropriately supported in bearings 37 and 38 which are positioned in the side plates 21 and 22, respectively, with the driven sprocket 33 conveniently positioned therebetween. It will thus be appreciated that activation of the drive motor 25 effects rotation of the main drive shaft 36 by virtue of the aforedescribed interconnection through the gear reducer 26 and the main drive chain assembly 30.

Figure 2:
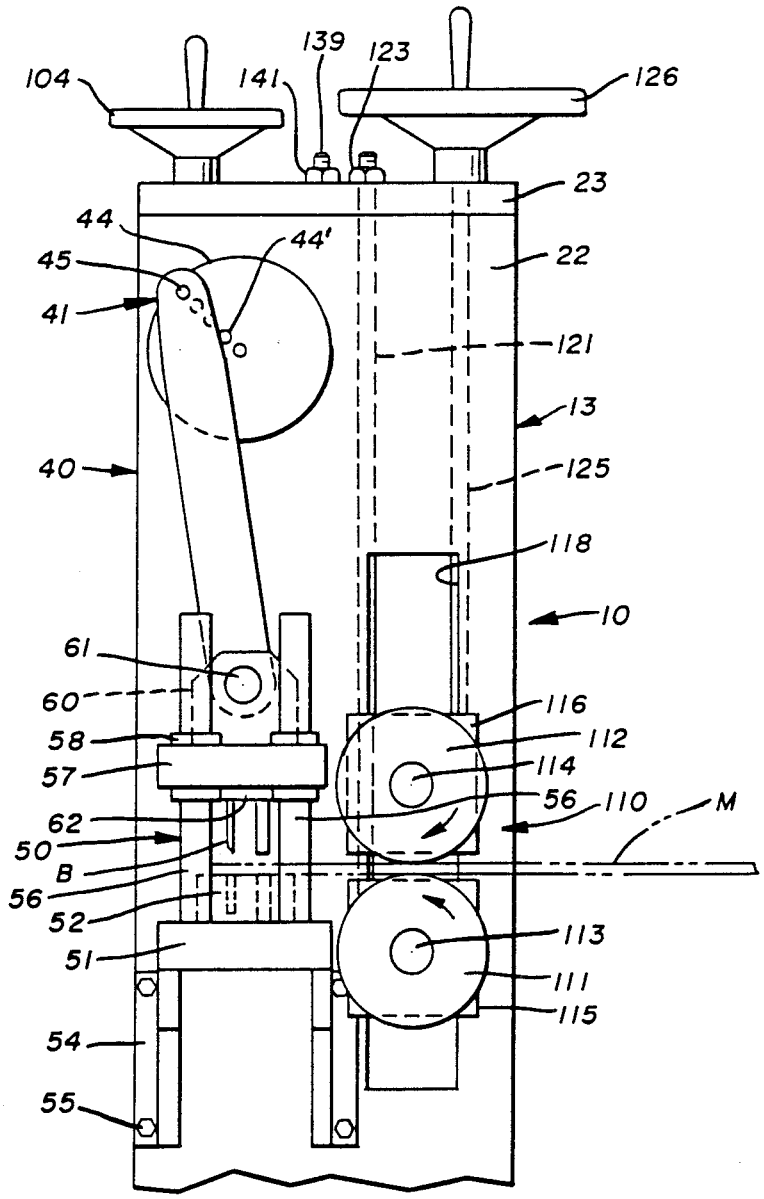
FIG. 2 is a fragmentary left side elevational view depicting, particularly, the cutting mechanism and material feed rolls of the cutter apparatus of FIG. 1.

Referring now to FIGS. 1*a* and 2, the main drive shaft assembly 35 powers a cutting assembly, generally indicated by the numeral 40. The cutting assembly 40 may conveniently interrelate with the main drive shaft assembly 35 outwardly of side plate 22 of the upper frame 13. More particularly, the main drive shaft 36 may carry outwardly of side plate 22 a cutter crank assembly, generally indicated by the numeral 41. The cutter crank assembly 41 includes a crank shaft 42 which is bored to receive the shaft 36 and is nonrotatably affixed thereon as by a key 43. The cutter crank assembly 41 has a crank web 44 which is rigidly affixed to the crank shaft 42. A crank pin 45 extends outwardly of the crank web 44 to the side of web 44 opposite the crank shaft 42 and is displaced radially a distance from the rotational center of crank web 44 in one of a plurality of bores 44' at differing radial locations As best seen in FIG. 1*a*, the crank pin 45 carries a crank arm 46 which extends a substantial distance downwardly from the crank pin 45. The crank arm 46 may have a suitable bearing 47 proximate the extremity thereof which engages the crank pin 45.

The extremity of crank arm 46 opposite the attachment to crank pin 45 interengages with a tool mounting assembly, generally indicated by the numeral 50. The tool mounting assembly 50, as shown herein, includes a base plate 51 upon which a lower tooling element 52 may be mounted. The base plate 51 is affixed at a selected vertical position on side plate 22 by a mounting plate 54 secured by a plurality of bolts 55. Extending upwardly from the base plate 51 are a plurality, preferably four, alignment pins 56. Movable vertically on the alignment pins 56 is a tool mounting plate 57 which may be provided with suitable bearings 58 for slidable movement of the tool mounting plate 57 relative to the alignment pins 56. The tool mounting plate 57 carries on its upper surface a bifurcated connecting block 60 which receives the lower extremity of crank arm 46 which is affixed thereto by a pin 61 for an extent of rotational freedom. It will thus be appreciated that the rotation of the main drive shaft assembly 35 will be converted to reciprocating motion of the tool mounting plate 57 of the tool mounting assembly 50.

The tool mounting plate 57 carries on the underside thereof an upper tooling element 62 which mounts a knife blade B or other tooling member for operative interengagement with the lower tooling element 52 on base plate 51. It is to be noted that, although a knife blade for cut off or partial severing purposes is depicted by way of example, suitable tooling elements to effect the spaced punching of apertures or to carry out other operations could be readily employed as will be appreciated by persons skilled in the art. It is also to be understood that other types of cutting elements such as a rotating blade could be employed by modifying the tool mounting assembly 50 as appropriate while maintaining the capability of the reciprocating motion of a tool element into and out of operative position as is effected by the tool mounting plate 57. It also will be appreciated that a cutting, punching or other operation by tool mounting assembly 50 is carried out at, or while the crank pin 45 is proximate, its vertically lowermost position as depicted in FIG. 1*a* of the drawings with the blade B or other tooling element being reciprocally moved vertically such that it is not in engagement with the lower tooling element 52 during the remainder of the rotation of the crank web 44. Thus, a single cutting or other tooling stroke or operation is effected for each rotation of the main drive shaft 36.

Figure 3:
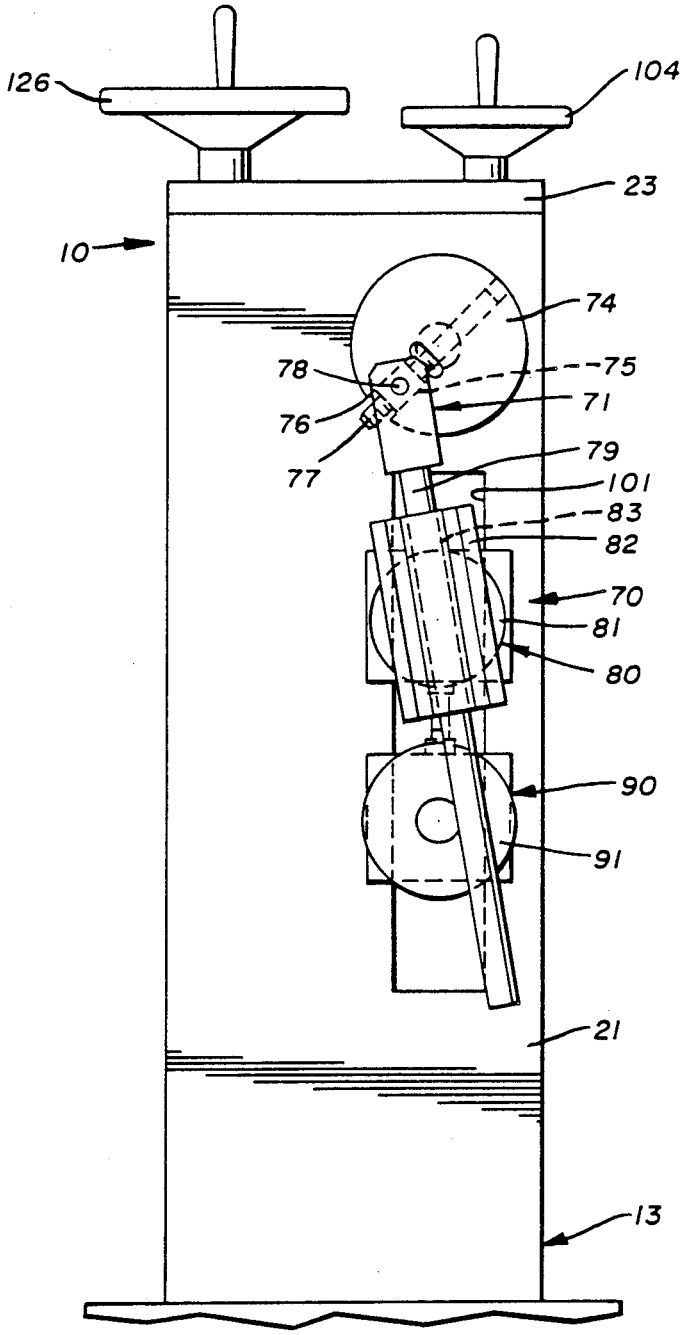
FIG. 3 is a fragmentary right side elevational view of the cutting apparatus of FIG. 1 showing, particularly, the drive mechanism for the material feed rolls.

The drive shaft assembly 35, in addition to powering the cutting assembly 40, also powers a material indexing assembly, generally indicated by the numeral 70, as seen in FIGS. 1*a* and 3. The material indexing assembly 70 may conveniently interrelate with the main drive shaft assembly 35 outwardly of side plate 21 of the upper frame 13. More particularly, the main drive shaft 36 may carry outwardly of side plate 21 an indexing crank assembly, generally indicated by the numeral 71. The indexing crank assembly 71 includes a crank shaft 72 which is bored to receive the main drive shaft 36 and is nonrotatably affixed thereon as by a key 73. The indexing crank assembly 71 has a crank wheel 74 which is rigidly affixed to the crank shaft 72. A crank pivot block 75 extends outwardly of the crank wheel 74 to the side of crank wheel 74 opposite the crank shaft 72. The crank pivot block 75 is positioned in a radial slot 76 in the crank wheel 74 to permit selective radial displacement of the crank pivot block 75 from a position at the center of the crank wheel 74 to the radial outward extremity of crank wheel 74. A machine screw 77 extending through crank pivot block 75 and into a portion radial slot 76 in crank wheel 74 may be employed to retain and move the crank pivot block 75 radially relative to the crank wheel 74. The crank pivot block 75 and crank pin 45 of cutter crank assembly 41 are preferably at substantially diametrically opposed locations relative to drive shaft 36 to minimize imbalance and attendant vibration.

Extending from the crank pivot block 75 of indexing assembly 71 is a crank pin 78. Rotatably attached to the crank pin 78 is a "wig wag" shaft or crank rod 7g. The "wig wag" rod 79 is operatively connected to a portion of a clutch assembly, generally indicated by the numeral 80, at a distance spaced from the pivot pin 78.

The clutch assembly 80 of material indexing assembly 70 consists of a first clutch 81 which is a one-way clutch, i.e., capable of driving in one direction only. The input to one-way clutch 81 is through coupling to a pillow block 82 which is oscillated by the "wig wag" shaft 79 and contains a linear bearing 83 internally thereof to allow the "wig wag" shaft 79 to move freely longitudinally thereof. It will thus be recognized that as the crank wheel 74 rotates through a 180° arc from a position where the crank pivot block 75 is at one lateral extremity to the other lateral extremity, the pillow block will move through its full extent of angular rotation in one direction and when the crank pivot block 75 moves from that lateral position through the remaining 180° arc to its original position, pillow block 82 will be rotated through an equal angle in the opposite direction. Since the clutch 81 is a one-way clutch, only one of these two components of angular motion are transmitted to the output shaft 84 of one-way clutch 81 by selective clutch activation and deactivation (FIG. 1*a*). Therefor with the crank pivot block 75 and crank pin 45 at diametrically opposed locations as specified hereinabove the material indexing assembly 70 drives through clutch assembly 80 when the crank pivot block 75 moves through the lower 180° arc with the blade B removed vertically from lower tooling element 52 and does not drive through clutch assembly 80 when crank pivot block 75 moves through the upper 180° arc when the blade B is proximate to or engaging the lower tooling element 52 during the cutting operation. The output shaft 84 of clutch 81 is coupled to the input of a second one-way clutch 85 having one side thereof locked to earth via frame 21 such that the output shaft 86 of clutch 85 is incapable of reverse rotation.

Interconnected with the clutch assembly 80 is a brake assembly, generally indicated by the numeral 90. The brake assembly 90 of material indexing assembly 70 consists of a dynamic brake 91 which is interconnected with the output shaft 86 of clutch 85 by a clutch-brake interconnect chain 95 which interengages with the output shaft 92 of brake 91. The clutch brake interconnect chain 95 engages a sprocket 87 on shaft 86 of clutch 85 and a sprocket 93 on the output shaft 92 of brake 91. The brake 91 is interconnected such that it operates to stop the drive of the clutch brake interconnect chain 95 and output shaft 92 immediately upon cessation of drive through one-way clutch 81 at which time the brake operates at its peak operating efficiency. The dynamic brake 91 is designed to reduce to a minimal amount the tendency of the material indexing assembly 70 elements to continue to move due to inertial forces after the clutch 81 is deactivated.

The clutch assembly 80 and the brake assembly 90 are mechanically interconnected other than through the clutch brake interconnect chain 95 by a spacer bolt 96 having nuts 97 thereon. The bolts 96 are threadably adjusted relative to the one-way clutch 85 and brake 91 to establish a preselected spacing between clutch 85 and brake 91 such that the chain 95 is maintained sufficiently taut such as to minimize backlash. The nuts 97 are threaded into engagement with clutch 85 and brake 91 to maintain the selected spacing.

While the extent of angular drive of clutch assembly 80 during each rotation of the crank wheel 74 is controlled primarily by the position of crank pivot block 75 radially of the crank wheel 74, there is also provision for fine adjustment of the extent of angular indexing per revolution of the crank wheel 74. This is effected by the mounting of one-way clutch 85 in a slide block 100. The slide block is positioned, in part, in a vertical slot 101 in the side plate 21. The slide block 100 has a medial portion 102 which resides in the slot 101 and has bifurcated lateral extremities 102' which inwardly and outwardly overlay the side plate 21. The vertical position of the slide block 100 relative to the slot 101 is maintained and adjusted by a threaded shaft 103 which engages mating threads (not shown) in the slide block 100. A hand wheel 104 may be provided to affect rotation of shaft 103 to effect vertical displacement of slide block 100 which carries clutch assembly 80 and brake assembly 90. It will thus be seen that upon raising and lowering the assemblies 80, 90 the pillow block 82 will be vertically displaced upwardly or downwardly such that the effective operating length of the "wig wag" shaft 79 is altered so that the extent of angular oscillation of pillow block 82 and thus the input shaft of clutch 81 may be varied, the raising of clutch assembly 80 producing a greater extent of angular indexing and the lowering effecting a reduced extent of angular indexing.

The material indexing assembly 70 engages and controls the input of rubber and plastic material M (FIG. 2) to the cutting assembly 40 by the operation of a feed roll assembly, generally indicated by the numeral 110. The feed roll assembly consists of a lower pinch roll 111 and an upper pinch roll 112. The pinch rolls 111, 112 may be made of any of a variety of materials which are known in the art for purposes of feeding extruded material M to a cutting blade assembly with the material M being engaged by the radially outer surfaces of rolls 111, 112 in non-slipping relation.

The pinch rolls 111, 112 are nonrotatably mounted on shafts 113 and 114, respectively. The shafts 113 and 114 are, in turn, rotatably mounted in slide blocks 115 and 116, respectively, which may be similar to the slide block 100 and are disposed to move in a slot 118 in the side plate 22. As seen particularly in FIGS. 2 and 5, the slide blocks 115, 116 are adapted for vertical movement in slot 118 which is an elongate vertical opening similar to slot 101. The lower slide block 115 is normally positioned so that the radially upper surfaces of the lower pinch roll 111 is substantially horizontally aligned with the upper surface of lower tool mounting element 52 which resides on base plate 51 of the tool mounting assembly 50. To accommodate lower tooling elements 52 of differing vertical height, the slide block 115 has an internally threaded bore 120 for engaging an elongate threaded shaft 121 which extends through an aperture 122 in slide block 116. The shaft 121 may have a lock nut 123 on a portion projecting through the top plate 23 to facilitate engagement by a wrench or other tool to effect the desired rotation of shaft 121.

Once the lower pinch roll 111 is adjusted relative to the tool mounting assembly 50, the upper pinch roll 116 is adjusted a distance thereabove to effect suitable frictional contact with the extruded material M which is to be controllably driven therebetween. Appropriate vertical adjustment of the slide block 116 carrying pinch roll 112 is effected by moving slide block 116 relative to the slot 118. This positioning is established and maintained by a threaded shaft 125 which matingly engages a threaded bore 127 internally of the slide block 116. The threaded shaft 125 may be provided with a hand wheel 126 positioned above the top plate 23 for purposes of facilitating adjustments in the distance between pinch rolls 111 and 112 either before or during operation of the cutting apparatus 10 to optimize consistent positive feed of the material M without inordinate drag or crushing.

Figure 4:
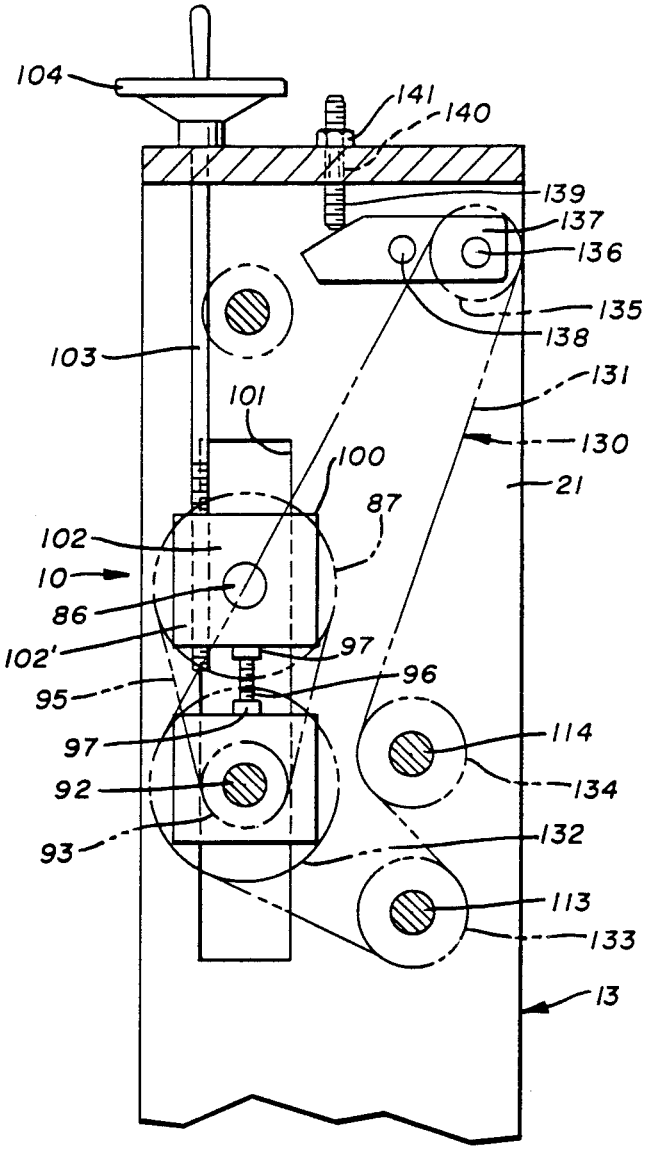
FIG. 4 is a fragmentary sectional view taken substantially along the line 4—4 of FIG. 1*a* and depicting, particularly, details of a portion of the chain drive mechanism for the material feed rolls.

The feed roll assembly 110 and the output shaft 92 of brake 91 of material indexing assembly 70 are interconnected by a feed roll drive assembly, generally indicated by the numeral 130 in FIGS. 1*a* and 4. The feed roll drive assembly 130 consists of a feed roll drive chain 131 which is driven by a sprocket 132 nonrotatably mounted on the output shaft 92 of brake 91 and which engages driven sprockets 133 and 134 that are nonrotatably mounted on the shafts 113 and 114, respectively, which mount the pinch rolls 111 and 112. The sprockets 133 and 134 are engaged by the feed roll drive chain 131 in such a manner that the lower pinch roll 111 rotates in a counterclockwise direction, as viewed in FIG. 2, and the upper pinch roll 112 rotates in a clockwise direction, similarly as viewed in FIG. 2, for feeding extruded material M to the tool mounting assembly 50.

The drive chain 131 also engages an idler sprocket 135 best seen in FIGS. 1*a* and 4 of the drawings. The idler sprocket is mounted on a shaft 136 which is carried by a lever arm 137 that is pivotally mounted on a pin 138 mounted on side plate 21. At a distance from the pin 138 in a direction opposite the location of shaft 136 the lever arm 137 is engaged by a threaded rod 139 which extends through a threaded bore 140 in the top plate 23. By threadingly adjusting the axial position of rod 139, the lever arm 137 rotates about pin 138 and idler sprocket 135 is rotated thereabout or generally moved up or down as viewed in FIG. 4 of the drawings to effect increasing or decreasing tension in the feed roll drive chain 131. A nut 141 on threaded rod 139 may be employed to lock the rod at any selected axial position. By thus adjusting the lever arm 137, the tension in feed roll drive chain 131 may be altered to accommodate variations in the position of the driven sprockets 133, 134 and the drive sprocket 132 and to ensure that the feed roll drive chain 131 is tensioned such as to prevent backlash which could result in variations in the length of material being cut during repetitive indexing operations.

Thus it should be evident that the cutting apparatus for extruded rubber and plastic materials disclosed herein carries out the various objects of the invention set forth hereinabove and otherwise constitutes an advantageous contribution to the art. As may be apparent to persons skilled in the art, modifications can be made to the preferred embodiment disclosed herein without departing from the spirit of the invention, the scope of the invention being limited solely by the scope of the attached claims.

I claim:

1. Apparatus for repeatedly cutting extruded rubber and plastic material at preselected locations along a length thereof comprising, frame means, drive shaft means mounted on said frame means, drive means effecting a selected speed of rotation of said drive shaft means, feed roll means intermittently driven by said drive shaft means for controllably incrementally advancing the extruded material, cutting means driven by said drive shaft means for repeatedly cutting the extruded material advanced by said feed roll means at the preselected locations, and indexing means having clutch means intermittently connecting said drive shaft means and said feed roll means and having indexing crank means interposed between said drive shaft means and said clutch means, said indexing crank means includes a crank shaft attached to said drive shaft means, a crank wheel affixed to the crank shaft, a crank pivot block attached to said crank wheel, a crank pin extending from said crank pivot block, and a crank rod attached to said crank pin and movable longitudinally in pillow block means attached to the input shaft of said clutch means for imparting oscillating motion to said pillow block means.

2. Apparatus according to claim 1, wherein said cutting means reciprocates through one cutting stroke for each rotation of said drive shaft means.

3. Apparatus according to claim 1, including cutter crank means converting rotation of said drive shaft means to reciprocation of said cutting means.

4. Apparatus according to claim 3, wherein said cutter crank means includes a crank shaft affixed on said drive shaft means, a crank web extending from said crank shaft, a crank pin extending outwardly of said crank web, and a crank arm attached to said crank pin and interengaging said cutting means to impart reciprocating motion thereto.

5. Apparatus according to claim 4, wherein said cutting means includes a tool mounting assembly and tooling elements mounted on said tool mounting assembly, said tool mounting assembly including a base plate, a tool mounting plate, means for aligning said tool mounting plate for movement relative to said base plate, and a connecting block on said tool mounting plate for attachment to the extremity of said crank arm opposite the extremity attached to said crank pin.

6. Apparatus according to claim 1, wherein said drive means is mounted on said same means and includes a drive motor, a gear reducer driven by said drive motor, a variable speed control for altering the rotational speed of said drive motor, and a drive chain assembly connecting said gear reducer with said drive shaft means.

7. Apparatus according to claim 1, wherein brake means is disposed at the output of said second one-way clutch to stop rotation of the output to said feed roll means upon deactivation of said first clutch means.

8. Apparatus according to claim 1, wherein said crank pivot block is selectively positioned in a radial slot in said crank wheel for varying the angular extend of oscillation of said pillow block means.

9. Apparatus according to claim 1, including slide block means mounting said clutch means for movement in slot means in said frame means to alter the operating length of said crank rod and thus vary the angular extent of oscillation of said pillow block means.

10. Apparatus according to claim 1, wherein said feed roll means are mounted on shaft means and an intermittently rotating shaft driven by said drive shaft means is interconnected by a feed roll drive assembly having sprocket means on each of said shaft means interconnected by a drive chain.

11. Apparatus according to claim 10, wherein said drive chain also engages an idler sprocket mounted on a movable lever for adjusting the tension in said drive chain.

12. Apparatus according to claim 1, wherein shafts mounting said feed rolls each mount sprockets engaged by a drive chain powered by a sprocket mounted on an output shaft of brake means disposed at the output of said clutch means.

13. Apparatus according to claim 1, wherein said drive chain also engages a movable idler sprocket for effecting increasing or decreasing tension in said drive chain to prevent backlash that could produce variations in cutting the extruded material from the preselected locations.

14. Apparatus according to claim 7, wherein said clutch means includes a first one-way clutch for driving said feed rolls in one direction for advancing the extruded material and a second one-way clutch coupled to the output of said first one-way clutch and having one side thereof locked to said frame means to preclude rotation of said feed rolls in the other direction.

* * * * *

UNITED STATES PATENT AND TRADEMARK OFFICE

CERTIFICATE OF CORRECTION

PATENT NO. : 4,986,155

DATED : January 22, 1991

INVENTOR(S) : DONALD F. HAYS, JR.

It is certified that error appears in the above-identified patent and that said Letters Patent is hereby corrected as shown below:

Column 5, line 15, "locations As" should read --locations. As--.

Column 6, line 32, "7g." should read --79.--.

Column 10, line 11, "same" should read --frame--.

Column 10, line 22, "extend" should read --extent--.

Column 10, line 44, "claim 1," should read --claim 12,--.

Column 10, line 50, "claim 7," should read --claim 1,--.

Signed and Sealed this

Eighteenth Day of May, 1993

*Attest:*

Michael K. Kirk

MICHAEL K. KIRK

*Attesting Officer*

*Acting Commissioner of Patents and Trademarks*